United States Patent [19]

Cosby

[11] Patent Number: 4,479,354

[45] Date of Patent: Oct. 30, 1984

[54] LIMITED EXPANSION VAPOR CYCLE

[76] Inventor: Thomas Cosby, 1639 E. 84th Pl., Chicago, Ill. 60617

[21] Appl. No.: 307,434

[22] Filed: Oct. 1, 1981

Related U.S. Application Data

[63] Continuation-in-part of Ser. No. 67,803, Aug. 20, 1979, abandoned.

[51] Int. Cl.[3] ..... F01K 21/00

[52] U.S. Cl. ..... 60/670; 60/645

[58] Field of Search ..... 60/651, 671, 690, 670, 60/645

[56] References Cited

U.S. PATENT DOCUMENTS 3,885,394 5/1975 Witt et al. ..... 60/651

4,037,414 7/1977 Nicodemus ..... 60/670

OTHER PUBLICATIONS

Keenan, *Thermodynamics* (1941), pp. 125, 136–139, 152, 153, 189 and 191, 192.

Wiley and Sons Inc., Engineering Thermodynamics, (1963), p. 598.

*Primary Examiner*—A. Michael Chambers

*Attorney, Agent, or Firm*—Willian, Brinks, Olds, Hofer, Gilson & Lione, Ltd.

[57] ABSTRACT

An apparatus and method for recycling or maintaining the latent heat of vaporization in work producing cycles such as the Rankine cycle by eliminating phase changes by replacing the condenser in such cycles with a compressor and restricting or limiting the expansion to reduce compressor work requirements.

The standard compound turbine prevalent today consisting of a single Curtis stage in tandem with pressure compounded stages has been replaced with several two-row Curtis stages.

An alternative embodiment utilizes one or several two-row Curtis stages and a condenser as in the Rankine cycle but limits the expansion, maintaining a relatively high pressure typical in exhaust from this type of turbines. The high pressure maintains the temperature of the condensate sufficiently high to eliminate feed water preheating.

Sacrifice of low pressure output is compensated in both cases by salvaging latent heat of vaporization which would not be possible economically, if expansion carried to the maximum. Sufficient heat is added in the boiler to restore the vapor to its operating condition and to replace any excess heat removed at the final stage of the turbine.

2 Claims, 5 Drawing Figures

FIG. 3
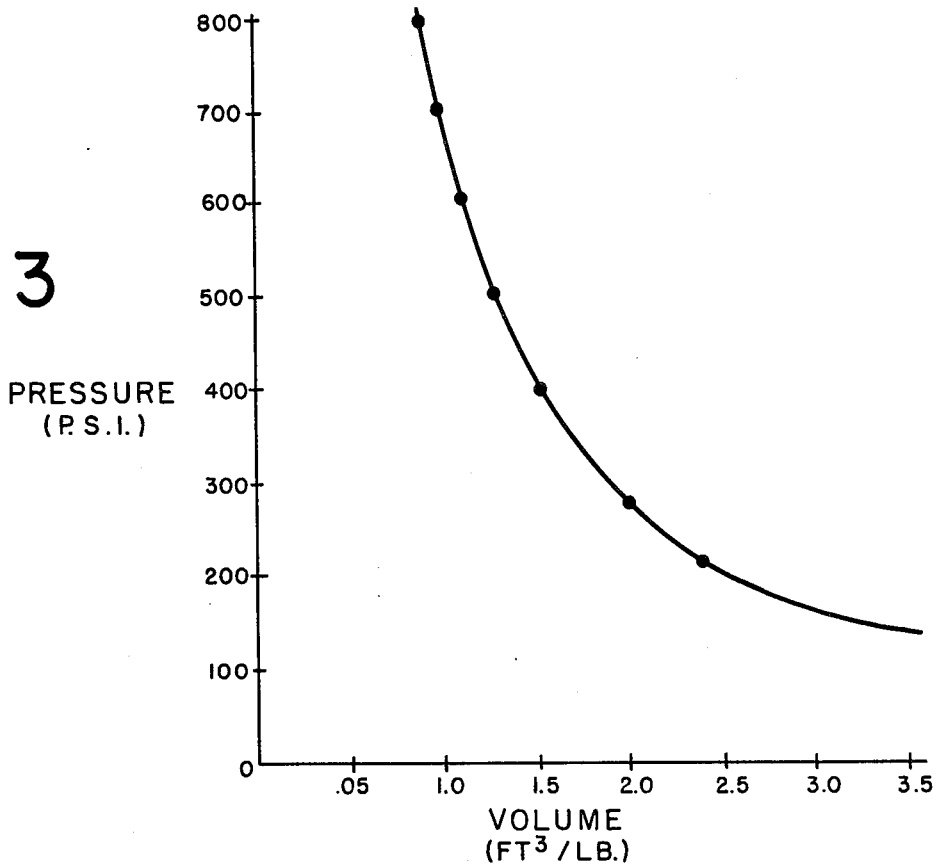
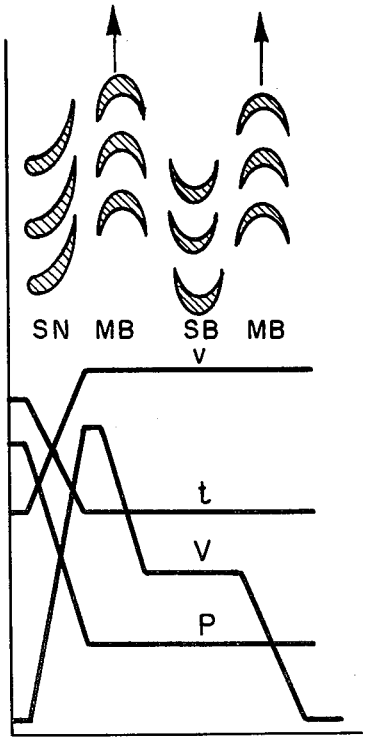
FIG. 4
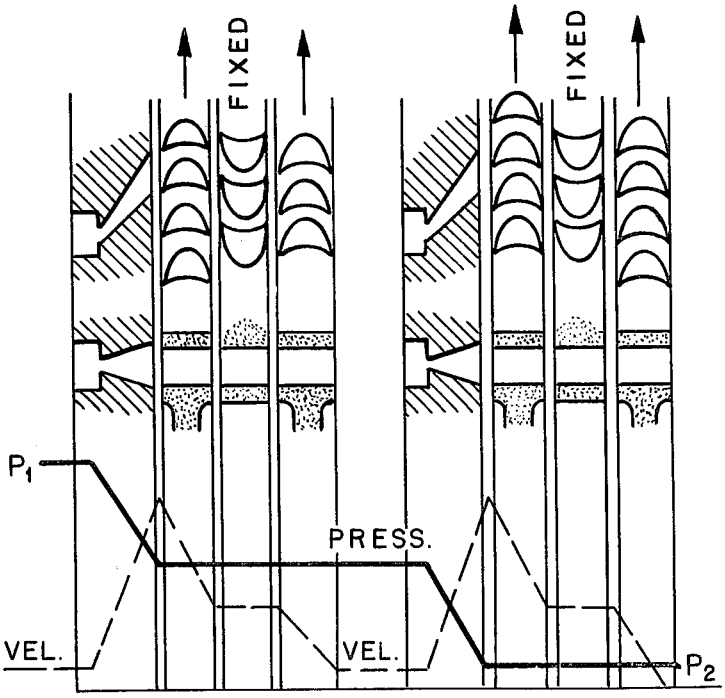
FIG. 5

LIMITED EXPANSION VAPOR CYCLE

This is a continuation-in-part of pending U.S. patent application Ser. No. 67,803, filed Aug. 20, 1979, now abandoned.

BACKGROUND AND SUMMARY OF THE INVENTION

The present invention relates to a method and apparatus for reducing the amount of fuel required to perform work in a vapor cycle by eliminating unnecessary phase changes. In particular, the present invention relates to a limited expansion vapor conversion cycle that is a modification of the conventional Rankine steam cycle.

In the known Rankine cycle, fuel is burned to heat a boiler vessel or vapor generator containing water, thereby generating steam. The steam is then passed through piping to a turbine or piston device to produce work. The pressure of the steam at the outlet end of the turbine is reduced substantially over the pressure at the inlet end of the turbine. At the outlet end of the turbine the depressurized steam is conveyed to a condenser where the steam is cooled and a partial vacuum is created, thereby producing a phase change from steam to water. The water is then returned to the boiler vessel or vapor generator, and the cycle is repeated.

According to the prior art, the pressure of the steam at the outlet end of the turbine is reduced to the maximum extent possible in comparison with the steam pressure at the inlet end of the turbine. Thus in the typical Rankine cycle two phase changes are used. First, water is heated to form steam before entering the turbine, and second, steam is condensed to form water after flowing through the turbine. For each pound of steam, approximately 970 BTU's of heat are required in the phase change from water to steam.

It is an object of the present invention in a vapor cycle for work to minimize or eliminate the phase change from steam or other vapor to water or other condensate, thereby eliminating the need for accomplishing the reverse phase change from vapor to condensate in the boiler. In this manner, the amount of fuel used in a steam or vapor cycle apparatus is reduced.

It is known in the art that a turbine is an engine which derives work from a steady stream of fluid. The working forces of the turbine come from changes in the momentum of the fluid. The turbine contains guides or blades that are moved by the fluid, and passages between the guides that also move as the fluid passes therethrough. In the moving passages of the turbine, the velocity of the stream of fluid relative to the moving guides is reversed in direction. The change in direction and velocity results in a force on the moving guides which can do work.

The turbine nozzle is a passage which is designed to increase the velocity of a flowing stream. The ratio of the velocity of the stream to its specific volume is referred to as the mass rate of flow per unit area.

The maximum flow or work through a turbine exists when the exhaust chamber or outlet pressure divided by the initial or inlet pressure produces a ratio of a little greater than one half. The pressure ratio at this section of maximum flow or work per unit area is referred to as the critical-pressure ratio. The critical-pressure ratio is applicable to both converging and converging-diverging nozzles in the turbines.

According to the present invention, there is provided a limited expansion vapor system whereby the phase change from steam or other vapor to water or other condensate is substantially reduced or eliminated. This is accomplished by utilizing a compressor or condenser that restricts the pressure of the vapor at the outlet end of a work deriving means to approximately one-half the inlet pressure, thereby restricting the expansion of the vapor to a minimum.

If a compressor is used, both condensate and compressed vapor may be produced. The compressed vapor is returned to a boiler means to be reheated, and the condensate is pumped to the boiler means. If a condenser is used, the output is condensate, which is pumped to the boiler means for reheating and a phase change to vapor. The embodiments described herein relate to a steam cycle apparatus utilizing water, but it is contemplated that other fluids which undergo a reversible phase change from liquid to vapor can be used.

Thus, one embodiment of the present invention comprises a boiler means for heating a mixture of vapor and liquid to produce a phase change to vapor; means for deriving work from the vapor produced by the boiler means, said work deriving means having at least one stage; means for compressing vapor output from the work deriving means; means for cooling said vapor output during compression; means for returning compressed vapor output to the boiler means; and means for pumping condensate produced by the compressor to the boiler means. The compressor capacity is matched to the vapor output of the final stage of the work deriving means so that the pressure of the vapor output is maintained at approximately one-half the final stage vapor inlet pressure, thereby restricting the expansion of the vapor output, and the compressor work. Inter- or intrastage cooling further reduces the compressor work.

According to an alternative embodiment there is provided a boiler means for heating a liquid to produce a phase change to vapor; means for deriving work from the vapor produced by the boiler means, said work deriving means having at least one stage; means for condensing the vapor output from the work deriving means to produce condensate; and means for pumping the hot condensate to said boiler means. The condenser capacity is chosen so that the pressure of the vapor output is approximately one-half the vapor inlet pressure of the final stage, thereby restricting the expansion of the vapor output, reducing condenser requirements, and reducing the need for feed water heating.

The invention also includes methods of converting heat to work by operating the above-identified embodiments of the vapor cycle apparatus of the present invention. Other advantages, objects and features of the present invention will become apparent upon reading the following detailed description of the preferred embodiment in conjunction with the accompanying drawings, which are schematic representations of the present invention.

BRIEF DESCRIPTION OF THE DRAWINGS

FIG. 3 is a standard steam pressure/volume graph;

FIG. 4 is a graph showing variations of pressure, temperature, specific volume and velocity relative to stationary elements of a turbine that occur across a Curtis stage turbine; and FIG. 5 is a graph showing the pressure/velocity history for a turbine having two Curtis stages.

DETAILED DESCRIPTION OF THE PREFERRED EMBODIMENTS

Figure 1:
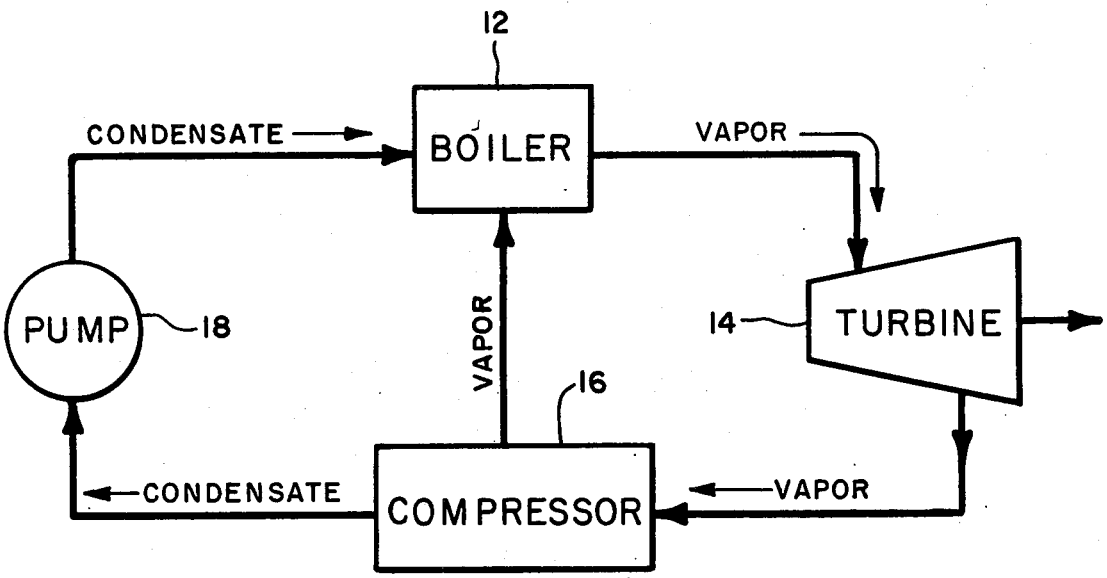
FIG. 1 is a schematic block diagram of the first embodiment of the vapor cycle apparatus of the present invention utilizing a compressor.

Referring now to the drawings, and in particular to FIG. 1, there is illustrated a limited expansion vapor cycle apparatus of the present invention. Therein, a boiler 12 produces vapor which is input to a work deriving means, shown in the preferred embodiment as turbine 14. The preferred turbine 14 has a two-row Curtis stage turbine, multiple Curtis stage (two-row) turbines or multiple two-row Curtis stage turbines. More than one such turbine 14 may be used. The most preferred turbine is a two-stage turbine wherein each stage is a two-row Curtis stage. The pressure used in the turbine should fall on the more nearly vertical portion of the pressure-volume graph (FIG. 3) where the pressure decrease is greatest per volume change minimum, when compared to the more nearly horizontal portion of the graph.

The physical changes that occur across the Curtis stage are shown by FIG. 4, which is taken from page 350 of Volume 22 of the *Encyclopaedia Britannica* (1967). "SN" stands for stationary nozzles, "MB" for moving blades, and "SB" for stationary blades; the movement and position of these blades are shown schematically. The graph depicts variations in pressure (P), temperature (t), specific volume (v) and velocity (V). It will be noted that there are an increase in volume (v), a drop in temperature (t) and pressure (P), and two changes in velocity (V). A substantial amount of energy remains in the steam because of the relatively high temperature and pressure which can be used in another or additional cycles (FIG. 5).

The chart of FIG. 5 is adapted from a figure on page 428 of a book entitled *Theory of Turbomachinery*, by G. Csandy. Fixed and movable blades are shown, with movable blades indicated by arrows, and the nozzles are at the left of each stage. The vapor flow is similar to that of FIG. 4. $P_1$ is the input pressure and $P_2$ is the outlet pressure. It can be seen in FIG. 5 that the velocity of the steam after leaving the second row of moving blades is decreased to virtually zero at the stage exit. Thus the kinetic energy stored in the stream of steam is converted almost totally into work.

Referring again to FIG. 1, the vapor from the output end of the turbine 14 is passed through a compressor 16, which repressurizes the vapor and inputs it to the boiler 12. Condensate, if any, which is produced by the compressor 16 is cycled through a pump 18 to the boiler 12. Most compressors can not accomplish total range compression efficiently in one stage, so multistage compression is the method most commonly used. To reduce the amount of compressor work required, interstage or intrastage cooling is performed. An Allis-Chalmers VS 305, using interstage cooling, is believed to be a suitable compressor for this application. According to the present invention, therefore, the phase change from vapor or steam to liquid or condensate is substantially reduced. In this manner, the amount of energy necessary to heat the vapor in the boiler 12 is reduced.

Compressor capacity is closely matched with the turbine output so that the vapor output from the final turbine stage has a pressure approximately one-half the stage vapor inlet pressure. Turbine and nozzle design theory show that this one-half pressure level, hereinafter referred to as the critical pressure ratio, is the point of maximum flow and of maximum work. Further reduction of the pressure of the vapor will not increase the amount of work which is performed by the vapor as it passes through the turbine 14. The output of the turbine 14 thus consists primarily of vapor at approximately one-half the final stage inlet pressure.

Therefore, it is expected that the limited expansion vapor cycle of the present invention will permit generation of work in the turbine 14 with greater efficiency than prior art systems. For instance, according to the present invention, using a particular embodiment with steam as the vapor and water as the liquid, the steam which enters the inlet end of the turbine 14 is superheated. After passing through the turbine 14, the steam exiting the outlet end of the turbine is saturated. It is expected that the volume of the steam will change minimally, as the steam passes through the turbine 14 of the present invention, thus reducing the amount of work required for compression. Compression work is further reduced by interstage or intrastrage cooling.

Figure 2:
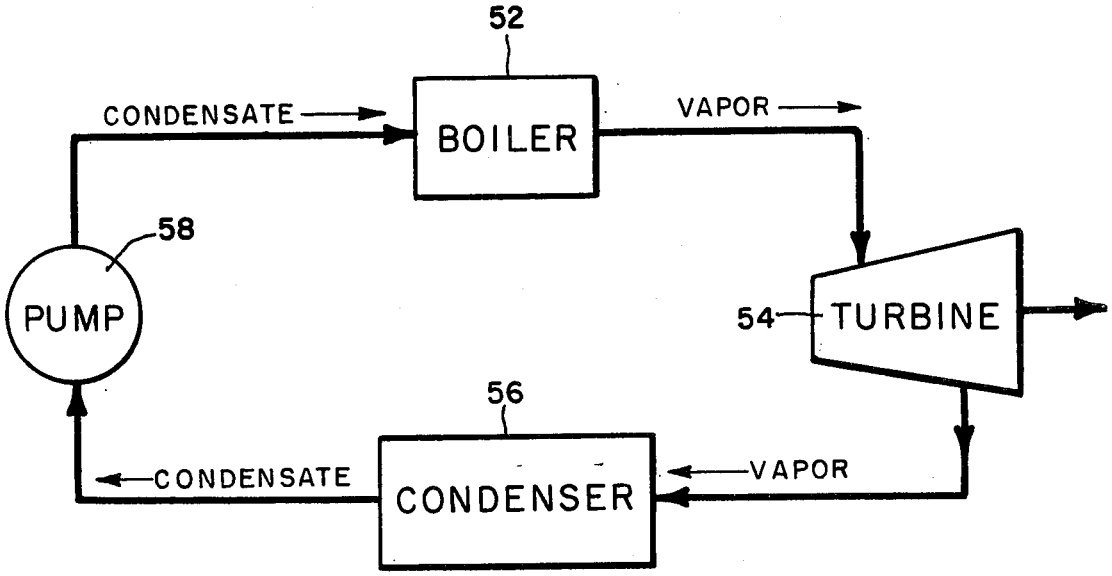
FIG. 2 is a schematic block diagram of a second embodiment of the vapor cycle apparatus of the present invention, utilizing a condenser.

According to a further embodiment of the present invention, as illustrated in FIG. 2, a limited expansion vapor cycle apparatus is provided which does not require a compressor, and can therefore be used as an interim alternate to the known Rankine cycle while awaiting compressors and other ancillary equipment. There is provided a boiler 52 that produces vapor input to a work deriving means, shown in this embodiment as a turbine 54. The vapor from the outlet end of the turbine 54 is passed to a condenser 56, with sufficient pressure capability to accept vapor exiting the final turbine stage 54 at the critical pressure ratio, or approximately one-half the stage inlet pressure of vapor into the turbine 54. This condenser 56 then converts the vapor to condensate by removing latent heat at the elevated pressure and temperature, and the condensate is pumped through a pump 58 to the boiler 52. It is expected that regenerative systems and feed water preheat will be obviated and a corresponding reduction in heat requirements will result. In each preferred embodiment of the invention, check valves (not shown) are provided as is known in the art to regulate flow direction.

According to the method of the invention heat is converted to work by heating a mixture of liquid or condensate and vapor in a vessel, such as the boiler 52, to convert the liquid to vapor at an initial pressure and temperature and to superheat it for doing work. The pressure of the vapor is then reduced to approximately one-half the initial desired pressure per Curtis stage as the vapor is passed through a turbine to perform work. In one embodiment of the method, the vapor is thereafter compressed after it exits the turbine and the compressed vapor and condensate produced, if any, are conveyed to the vessel. Inter- or intrastage cooling is used during the compression cycle.

In a further embodiment of the method, the vapor (exiting the final turbine stage) is cooled to a temperature corresponding to the pressure in the final stage exhaust to produce condensate, and the condensate is pumped to the vessel. In each embodiment of the method, the preferred liquid is water and the preferred vapor is steam.

The examples below are intended to set forth applications of the apparatus and method of the present invention, which is defined by the claims following thereafter. Furthermore, though the embodiments hereinbefore described are preferred, other modifications and refinements which do not depart from the true spirit and scope of the invention may be conceived by those of ordinary skill in the art. It is intended that all such modifications and refinements be covered by the claims which follow the examples below.

EXAMPLE I

The Winnetka, Ill. electrical generating facility has had a boiler producing approximately 125,000 pounds of steam per hour that drives a 10,000 kilowatt (13,400 horsepower) generating system. The system has a pressure of operation of 420 psia. The work derived from the turbine of such a system is approximately 6.44 horsepower per pound of steam per minute, or about 273 BTU.

With an apparatus according to the embodiment of FIG. 1, having a boiler using 1400 BTU/lb. of steam, a compressor which uses input electricity at an equivalent of 144 BTU/lb., a pump which uses 1 BTU/lb., and a compound Curtis stage turbine that can produce work at a rate of 273 BTU/lb., the heat drop between the turbine and the compressor is approximately 200 BTU/lb. A suitable compressor is the Allis-Chalmers VS-305 with interstage cooling, which requires 144 BTU per pound of steam or 3.4 horsepower/lb. and can compress the output from the Winnetka electrical generating facility. Additional inter- or intrastage cooling would reduce compressor work even more and/or superheat could be reduced because turbine condensation will be less probable.

The net heat consumed per pound of steam in typical steam cycles is about 1145 BTU/lb. It can be seen that the present invention will use approximately 200 to 240 BTU/lb. or about one-fifth the amount in typical systems of the prior art. The improved efficiencies resulting are calculated for the apparatus of the present invention as 79.1% (273/1+144+200), or 64.2% (273−144/20l) if part of the turbine output will be used to run the compressor.

EXAMPLE II

According to the embodiment of the invention illustrated in FIG. 2, steam in the boiler is brought to an original state of enthalpy of approximately 1257 BTU/lb. At 1000 psia the temperature of the saturated water is 544.6° F. and the enthalpy is 543 BTU/lb. With an output from the turbine at 560 psia, satisfying the critical pressure ratio, the enthalpy of the steam is about 1204 BTU/lb. The condenser operates to remove 741 BTU/lb. of heat, leaving the enthalpy of the condensate at approximately 463 BTU/lb. It can be seen, therefore, that only 794 BTU/lb. need be added to reestablish the original boiler condition, instead of the 1145 BTU/lb. required in the prior art.

I claim:

1. A limited expansion vapor cycle apparatus comprising:

means for heating a fluid to produce a vapor;

means for deriving work from the vapor produced by said means for heating wherein the input pressure of said work deriving means is at a level such that the change in pressure of the vapor during operation of said work deriving means occurs at a greater rate than the change of the volume of the vapor, said work deriving means having at least one stage;

means for compressing vapor from the outlet end, wherein the compressor capacity is matched to the vapor output of the final stage of the work deriving means so that the pressure of the output is approximately one-half the final stage vapor inlet pressure, thereby restricting the expansion of the vapor output;

means for cooling the vapor during compression;

means for returning said compressed vapor to said means for heating; and means for pumping a condensate produced during compression to said means for heating.

2. A limited expansion vapor cycle apparatus comprising:

means for heating a fluid to produce a vapor;

a multiple stage turbine wherein each stage is a two-row Curtis stage, for deriving work from the vapor produced by said means for heating wherein the input pressure of said turbine is at a level such that the change in pressure of the vapor during operation of said turbine occurs at a greater rate than the change of volume of the vapor;

means for compressing vapor from the outlet end, wherein the compressor capacity is matched to the vapor output of the final stage of the turbine so that the pressure of the output is approximately one-half the final stage vapor inlet pressure, such that the expansion of the vapor outlet is limited;

means for cooling the vapor during compression;

means for returning said compressed vapor to said means for heating; and means for pumping a condensate produced during compression to said means for heating.

* * * * *